US006390614B2

(12) United States Patent
Urlaub

(10) Patent No.: US 6,390,614 B2
(45) **Date of Patent: *May 21, 2002**

(54) FLUID-JET PRINT CARTRIDGE AND METHOD

(75) Inventor: Kevin Urlaub, Boise, ID (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/478,752

(22) Filed: Jan. 6, 2000

(51) Int. Cl.[7] ..... B41J 2/175
(52) U.S. Cl. ..... 347/86
(58) Field of Search ..... 347/85, 86, 87; 222/206; 264/250; 53/86

(56) References Cited

U.S. PATENT DOCUMENTS

| | | | | |
|---|---|---|---|---|
| 3,930,260 A | | 12/1975 | Sicking | 347/68 |
| 4,578,687 A | | 3/1986 | Cloutier et al. | 347/44 |
| 4,677,447 A | | 6/1987 | Nielsen | 347/87 |
| 4,943,816 A | | 7/1990 | Sporer | 346/25 |
| 5,531,055 A | * | 7/1996 | Sell et al. | 53/86 |
| 5,560,837 A | | 10/1996 | Trueba | 216/27 |
| 5,706,039 A | | 1/1998 | Chamberlain et al. | 347/47 |
| 5,721,576 A | * | 2/1998 | Barinaga | 347/85 |
| 5,790,157 A | * | 8/1998 | Higuma et al. | 347/85 |
| 6,022,102 A | * | 2/2000 | Ikkatai et al. | 347/85 |
| 6,033,610 A | * | 3/2000 | Swanson et al. | 264/250 |
| 6,247,803 B1 | * | 6/2001 | Kanaya et al. | 347/86 |

FOREIGN PATENT DOCUMENTS

| | | | | |
|---|---|---|---|---|
| EP | 0536980 A2 | * | 4/1993 | B41J/2/175 |
| JP | 410044458 A | * | 2/1998 | B41J/2/175 |
| WO | WO83/00932 | * | 3/1983 | G01N/37/00 |

* cited by examiner

*Primary Examiner*—Anh T. N. Vo

(57) ABSTRACT

A fluid jet print cartridge has a cartridge body including a fine-dimension diaphragm portion bounding a printing fluid chamber. This printing fluid chamber is substantially filled with printing fluid, such as ink, by penetrating the fine-dimension diaphragm portion and injecting the printing fluid, while simultaneously using the penetrated diaphragm portion as a barrier to prevent upwelling of printing fluid outwardly of the printing fluid chamber at the penetrated diaphragm.

13 Claims, 2 Drawing Sheets

FLUID-JET PRINT CARTRIDGE AND METHOD

BACKGROUND OF THE INVENTION

1. Field of the Invention

Figure 1:
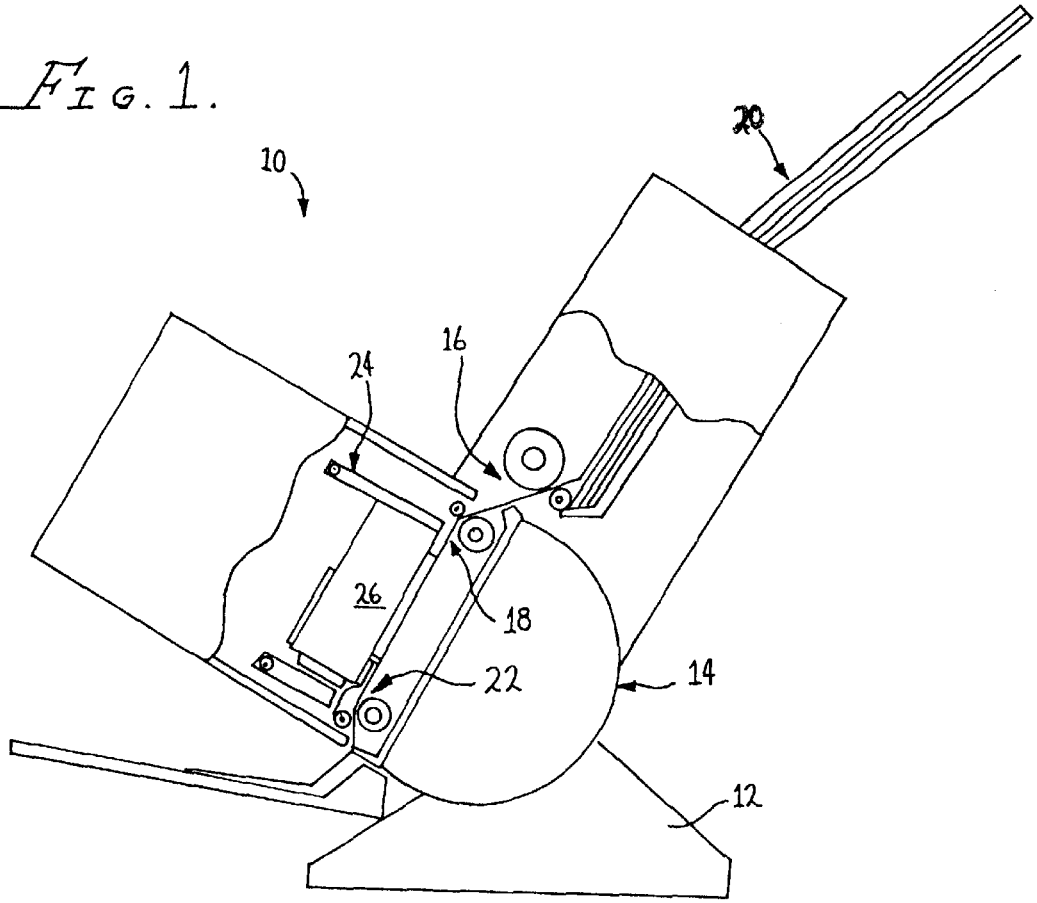

This invention relates generally to thermal inkjet printing. More particularly, this invention relates to an inkjet printer having an inkjet print cartridge that is substantially filled with printing fluid (i.e., with ink, for example), to such a print cartridge, and to a method for manufacturing such an inkjet print cartridge.

2. Related Technology

Inkjet printers or plotters typically have a print cartridge mounted on a carriage. This carriage is traversed back and forth across the width of a print medium (i.e., usually paper or a plastic plotting film, for example) as the print medium is fed through the printer or plotter. Plural orifices on the print cartridge are fed ink (or other printing fluid) by one or more channels communicating from a reservoir of the print cartridge. Energy applied individually to addressable resistors (or other energy-dissipating elements, for example, to piezoelectric actuators), transfers energy to printing fluid which is within or associated with selected ones of the plural orifices. This energy causes a portion of the printing fluid to momentarily convert to vapor phase and to form a vapor bubble. Thus, this type of printer is also sometimes referred to as a "bubble jet printer." As a result of the formation and expansion of the vapor bubble, some of the ink is ejected out of the respective orifice toward the print medium (i.e., forming an "ink jet"). As the ink is ejected, the bubble collapses almost simultaneously, allowing more ink from the reservoir to fill the channel. This quick ejection of an ink jet from a selected orifice, and almost simultaneous collapse of the bubble which caused this ejection, allows for the ink jet printing cycle to have a high repetition rate.

Customer demands and competitive pressures combine to create a desire for print cartridges to last as long as is practicable in such an ink jet printer. However, conventional ink jet print cartridges are not completely filled with printing fluid or ink even when they are brand new and freshly manufactured. This is the case because the exigencies and market economics of serial manufacturing for such ink jet print cartridges requires that they be filled with ink or printing fluid quickly using automated machinery. This automated machinery injects the ink into the print cartridges, and none of the injected ink dare spurt or leak out of the print cartridges during this filling process because it would interfere with subsequent manufacturing steps, and also could contaminate the automated ink filling machines. Thus, a volume cushion or lost volume of the print cartridge must be conventionally allowed, which lost volume is not filled with ink in order to be sure that none of the ink is leaked or spurted out of the cartridges during the ink filling step of serial manufacturing.

Consequently, for conventional ink jet print cartridges, there is a certain form factor characteristic of the exterior dimensions and volume of the cartridge, and of the concomitant internal volume of the ink reservoir defined within the print cartridge. Conventional ink jet print cartridges achieve only a fractional filling with ink of this form factor volume for the print cartridges, and do not achieve substantial filling with printing fluid of the printing fluid chambers of the conventional print cartridges. Consequently, conventional inkjet print cartridges have a shorter life, and provide a smaller number of characters printed or images formed than would be the case if the form factor for the cartridge were more fully utilized to contain printing fluid within the print cartridge.

Conventional ink jet print cartridges or components for such cartridges are seen in U.S. Pat. Nos. 3,930,260; 4,578,687; 4,677,447; 4,943,816; 5,560,837, and 5,706,039. However, none of these conventional ink jet print cartridges are believed to offer a substantial filling of the form factor volume of the print cartridge with printing fluid. Thus, all the known inkjet print cartridges require their replacement at more frequent service intervals than are desired. This frequency of replacement interferes, of course, with the use of the printers having such conventional inkjet print cartridges.

SUMMARY OF INVENTION

In view of the deficiencies of the related technology, an object for this invention is to reduce or overcome one or more of these deficiencies.

Accordingly, the present invention provides an inkjet print cartridge for ejecting printing fluid, the inkjet print cartridge comprising: a print cartridge body defining a chamber for receiving printing fluid, the print cartridge body carrying a printhead for controllably ejecting fine-dimension droplets of the printing fluid; the print cartridge body including a filling passage extending between but short of communication of the printing fluid chamber outwardly on the print cartridge body, and a penetrable diaphragm portion spanning and closing the filling passage.

According to another aspect, this invention provides a fluid jet printer having extended service intervals between changing of a print cartridge of the printer, the printer comprising: a base carrying a housing defining a printing path, a print medium feed mechanism controllably moving print medium through the printer along the printing path, a traverse mechanism carrying a fluid jet print cartridge for movement generally transversely to the printing path; the fluid jet print cartridge including: a cartridge body defining a printing fluid chamber, and carrying a printhead for controllably ejecting fine-dimension droplets of the printing fluid; the cartridge body including a filling passage extending between but short of communication of the printing fluid chamber outwardly on the print cartridge body, and an integral penetrable diaphragm portion spanning and closing the filling passage.

Still another aspect of the present invention provides a method of making a fluid jet print cartridge, the method comprising steps of: providing a print cartridge body defining a printing fluid chamber; providing a wall portion bounding the printing fluid chamber, and providing in the wall portion a filling passage extending between the printing fluid chamber and ambient but stopping short of communication of the printing fluid chamber outwardly of the print cartridge with ambient; providing a fine-dimension diaphragm portion at the filling passage, the fine-dimension diaphragm portion spanning and closing the passage and also bounding the printing fluid chamber; penetrating the fine-dimension diaphragm portion and injecting printing fluid into the printing fluid chamber; while injecting the printing fluid into the printing fluid chamber simultaneously utilizing the penetrated diaphragm portion to inhibit upwelling of printing fluid at the penetrated diaphragm portion and outwardly of the print cartridge along the filling passage.

Other objects, features, and advantages of the present invention will be apparent to those skilled in the pertinent arts from a consideration of the following detailed description of a single preferred exemplary embodiment of the invention, when taken in conjunction with the appended drawing figures, which will first be described briefly.

BRIEF DESCRIPTION OF THE DRAWING FIGURES

Figure 2:
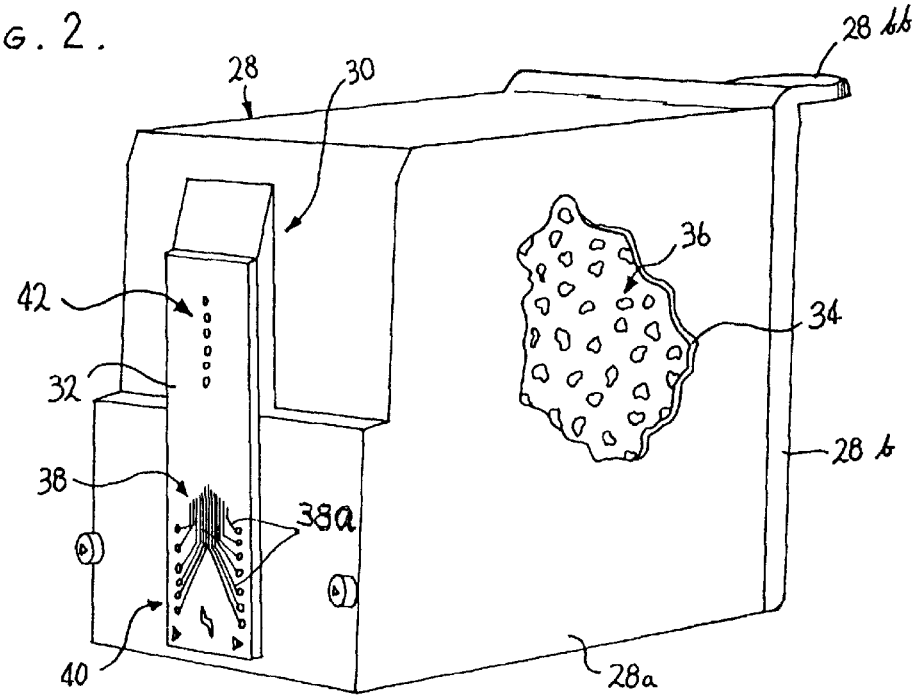
Figure 3:
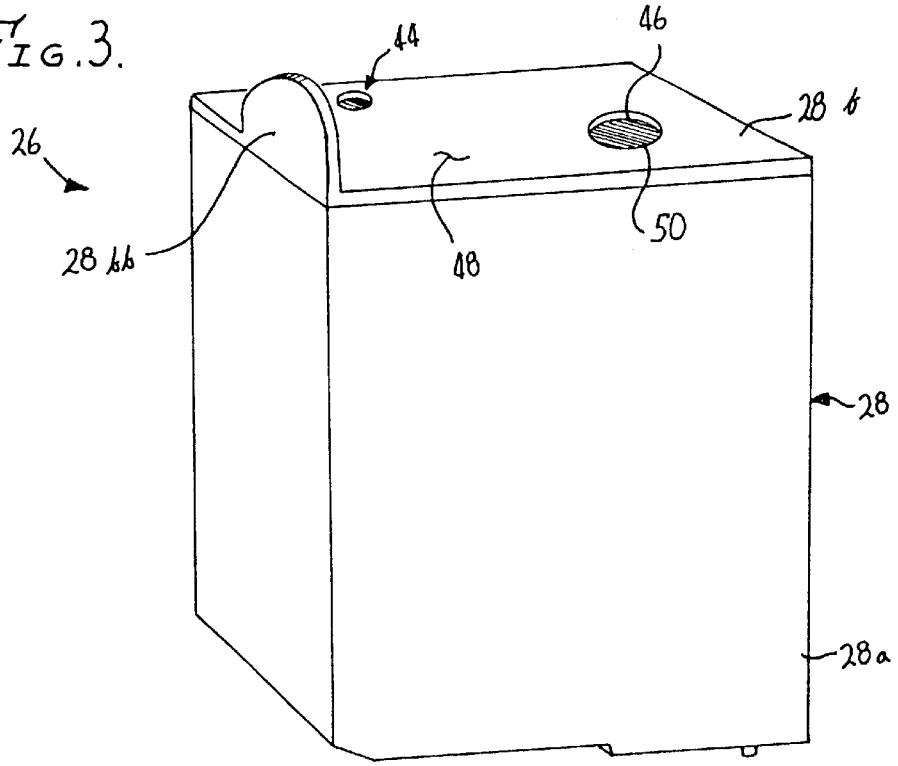
Figure 4:
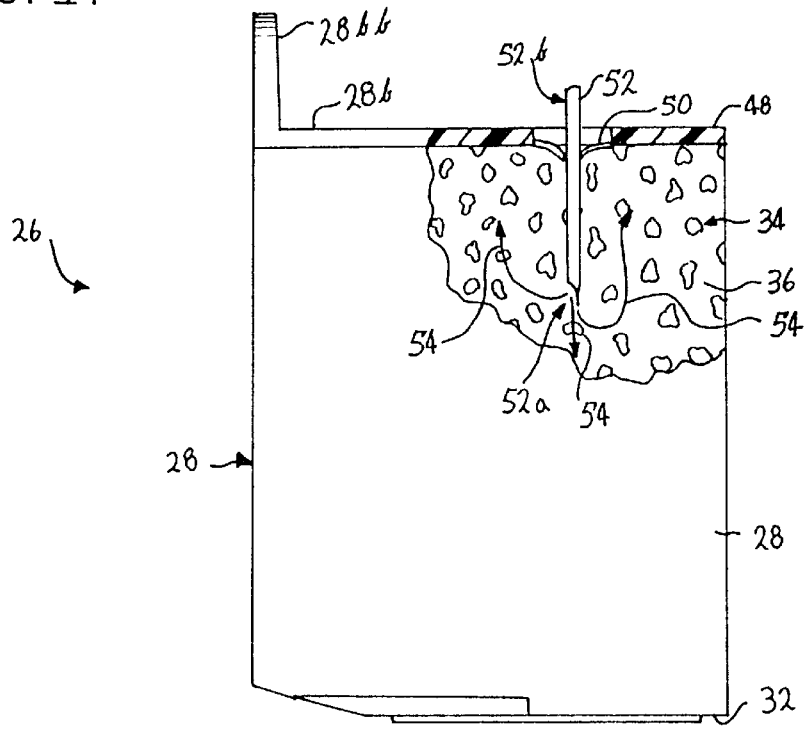

FIG. 1 is a diagrammatic side elevation view of an inkjet printer which uses an exemplary inkjet print cartridge embodying the present invention;

FIG. 2 provides a perspective view of an exemplary inkjet print cartridge, which may be used in the printer of FIG. 1, and with a portion of the inkjet print cartridge broken away for clarity of illustration;

FIG. 3 shows an other perspective view of the exemplary inkjet print cartridge, and illustrates this inkjet print cartridge at a selected stage of manufacture; and FIG. 4 provides a side elevation view of the inkjet print cartridge seen in FIG. 3 during a subsequent ink-filling step of manufacturing for this inkjet print cartridge.

DETAILED DESCRIPTION OF A PREFERRED EXEMPLARY EMBODIMENT OF THE INVENTION

FIG. 1 shows an exemplary inkjet printer 10. This printer 10 includes a base 12 carrying a housing 14. Within the housing 14 is a feed mechanism 16 for controllably moving a print medium (i.e., paper this case, although the invention is not so limited) through the printer 10. Those ordinarily skilled in the pertinent arts will understand that the feed mechanism 16 may be configured to feed sheet paper or medium, or may be configured to feed roll paper or medium, or may be configured to feed print medium of another shape or style. In this exemplary printer 10, the feed mechanism 16 controllably moves a single sheet of paper 18 from a paper magazine 20 along a print path 22 within the printer 10. The printer 10 includes a traverse mechanism 24 (i.e., a carriage) carrying an inkjet print cartridge 26. The traverse mechanism moves the inkjet printing cartridge 26 perpendicularly to the direction of movement of the paper 18 (i.e., the cartridge 26 is moved perpendicularly to the plane of FIG. 1). The printer 10 uses the inkjet printing cartridge 26 to controllably place small droplets of printing fluid (i.e., ink, for example) from the inkjet printing cartridge 26 on the paper 18. By moving the inkjet printing cartridge 26 repeatedly back and forth across the paper 18 as this paper is advanced by the feed mechanism 16 characters or images may be controllably formed by ejection and placement on the paper 18 of many small droplets of ink from the cartridge 26. These small droplets of ink are ejected in the form of ink jets impinging on the paper 18 in controlled locations to form the desired characters and images, as will be well known to those ordinarily skilled in the pertinent arts.

FIGS. 2–4 in conjunction illustrate the exemplary inkjet printing cartridge 26. This inkjet printing cartridge 26 includes a cartridge body 28. This cartridge body includes a molded, generally rectangular, and cup-like body portion 28*a*; and a molded complimentary closure or lid portion 28*b*. Both the body 28*a* and lid 28*b* may be molded of polymer (i.e., ("plastic"), as is well known to those ordinarily skilled in the pertinent arts. From the lid portion 28*b* extends a tab 28*bb*, which provides for manual purchase on the print cartridge 28. That is, the user of a print cartridge 28 may grasp the tab 28*bb* in order to, for example, insert the print cartridge into the carriage 24 of the printer 10 or to remove the print cartridge from this carriage.

The body portion 28*a* defines a fluid delivery assembly (generally referenced with the numeral 30) supplying printing fluid (such as ink) to a printhead 32 externally carried on this body portion 28*a*. The fluid delivery assembly 30 may include an open-cell, fine-grained sponge 34 carried within a chamber 36 of the body 28, and a standpipe (not shown), conveying the printing fluid from the chamber 36 to the printhead 32. The body portions 28*a* and 28*b* cooperatively define and bound the chamber 36 to receive the sponge 34 along with a supply of printing fluid (i.e., ink) within this chamber to the printhead 32.

Those ordinarily skilled in the pertinent arts will understand that the printhead 32 includes a printing circuit 38 which electrically couples the printhead 32 with the printer 10 via circuit traces 38*a* and plural electrical contacts 40. That is, the electrical contacts 40 individually make electrical contact with matching contacts (not seen in the drawing Figures) on the traverse mechanism 24, and provide for electrical interface of the printhead 32 with electrical driving circuitry (also not illustrated in the drawing Figures) of the printer 10. Individual ones of plural fine-dimension orifices 42 of the printhead 32 eject printing fluid when appropriate control signals are applied to selected ones of the plural contacts 40. That is, the fine-dimension orifices 42 controllably eject fine-dimension droplets of printing fluid onto the print medium 18 in order to form characters and images on this print medium.

As is seen in FIG. 2, the print cartridge 28 has a selected size and shape so that it will interface with the printer 10. The various combinations of size and shape for print cartridges are recognized in the pertinent art as bestowing each particular design of print cartridge with a "form factor," which is indicative of the maximum possible and practicable volume of ink each particular print cartridge can hold. That is, in view of the size and shape of the print cartridge 28, it is easily understood that the chamber 36 has a certain maximum practicable volume, and that this volume is in part filled with the sponge 34. Thus, the print cartridge 28 has a certain maximum volume of ink that it could hold were the chamber 36 substantially completely filled with ink (i.e., in the sponge 34) during manufacturing of the print cartridge 28.

Viewing now FIG. 3, the print cartridge 28 is seen at an intermediate stage of manufacturing, and before it is filled with ink. At this stage of manufacture, the body portions 28*a* and 28*b* have been sealingly united to close chamber 36 containing sponge 34, and the printhead 32 is carried on the body portion 28*a*, but the print cartridge contains no ink. As is seen in FIG. 3, this print cartridge 28 includes at the closure member or lid portion 28*b* both a vent opening 44, and a blind filling recess 46. The lid portion 28*b* of the print cartridge 28 includes a wall portion 48, which defines the filling recess 46. Thus, the blind filling recess 46 provides a blind passage leading toward but short of communication between the chamber 36 and ambient. That is, as is seen in FIG. 3, the filling recess 46 is a blind recess, and is spanned and closed by an integral, thin-wall, diaphragm portion 50. Preferably, the diaphragm portion 50 is an integral portion of wall 48, which thin-wall diaphragm portion is about 0.005 to 0.010 inch thick, and completely spans and closes the filling recess 46. In other words, the diaphragm portion 50 is non-penetrated, is complete in that is spans and closes the recess 46, and is penetrable because it is so thin and is formed of molded plastic. Those ordinarily skilled in the pertinent arts will, however, recognize that the diaphragm portion 50 need not be integral with wall 48. That is, the diaphragm portion 50 may be provided by utilizing a diaphragm part or penetrable plug part, for example, that is separate from the wall portion 48 and is received in a through filling passage (i.e., which through filling passage may be at the location of recess 46).

However, in view of the above, and as is seen in FIG. 3, it will be understood that during manufacturing of the print cartridge, and because at this stage of manufacturing the filling recess is closed by integral diaphragm portion 50, when the lid portion 28*b* is united sealingly with the cup-like body portion 28*a*, the chamber 36 is completely closed from ambient except for the limited communication provided by vent opening 44 and except for the to very limited communication with ambient provided via the plural fine-dimension orifices 42 of the printhead 32. Both of these openings and paths of limited communication to ambient for the chamber 36 (i.e., the vent opening 44 and the orifices 42 are much too small for use in filling the chamber 36 with ink. So, in view of the above, it is seen that the print cartridge 28 at the intermediate stage of manufacturing seen in FIG. 3 is effectively not possible to be filled with ink by conventional techniques.

However, FIG. 4 illustrates that the print cartridge 28 is effectively and quickly filled with ink during manufacturing according to this invention by penetrating the diaphragm portion 50 with a filling needle 52. The filling needle 52 is forced through the diaphragm portion 50 so that an open (i.e., and sharp) distal end 52a of the needle 52 is penetrated into the sponge 34, and sets well within the chamber 36. With the filling needle so positioned within chamber 36 and sponge 34, a selected quantity of ink is injected, as is indicated by arrows 54. As is seen in FIG. 4, during this ink injection step, the penetrated diaphragm portion 50 does not sealingly engage the shaft portion 52*b* of the needle 52, but does still continue to substantially close the filling recess 46 in combination with the needle 52. That is, the diaphragm portion 50 continues to substantially obstruct the recess 46, and to form a barrier around the needle shank 52*b* against ink flowing from chamber 36 into recess 46 along the needle shank 52*b*. Thus, the ink filled into the chamber 36 does not flow outwardly along the recess 46 to contaminate the exterior surfaces of the cartridge 28, or to foul the ink filling machine used in this step. Air displaced from the chamber 36 as a result of the injection of ink into this chamber and the sponge 34 is substantially vented via the vent opening 44. On the other hand, because the needle 52 does not sealingly engage with the diaphragm portion 50, some air may be vented between the needle shaft 52*b* and the diaphragm 50. However, the surface tension and viscosity of the injected ink discourages ink from welling up in the recess 46 by passage between the shaft 52*b* and the penetrated diaphragm portion 50.

Consequently, the chamber 36 and sponge 34 are substantially filled with ink injected via needle 52. A greater filling of chamber 36 with ink is achieved according to the present invention than can be achieved with conventional ink jet print cartridges. This is the case, as was explained in greater detail above, because if conventional inkjet print cartridges were substantially filled with ink, they would allow ink to well up at their filling openings during ink filling of the cartridges, and this ink would interfere with further manufacturing processes for the inkjet cartridges, and could also foul the manufacturing machines.

However, with the present inventive inkjet print cartridge once the ink injection step illustrated in FIG. 4 is complete, the needle 52 is withdrawn, and the ink fill recess 46 is preferably closed either by a sealing plug inserted into this recess, or by use of an adhesive label that spans across the recess 46 and scalingly engages with the wall 48. Thus, this label sealingly closes the recess 46 also.

Those skilled in the art will further appreciate that the present invention may be embodied in other specific forms without departing from the spirit or central attributes thereof. Because the foregoing description of the present invention discloses only a particularly preferred exemplary embodiment of the invention, it is to be understood that other variations are recognized as being within the scope of the present invention. Accordingly, the present invention is not limited to the particular embodiment which has been described in detail herein. Rather, reference should be made to the appended claims which define the spirit and scope of the present invention.

What is claimed is:

1. An inkjet print cartridge, said inkjet print cartridge comprising:

a print cartridge body defining a chamber for receiving printing fluid, said print cartridge body carrying a print head for controllably ejecting fine-dimension droplets of fluid;

said print cartridge body including a filling passage extending between said chamber and ambient but stopping short of communicating said chamber outwardly on the print cartridge body with ambient, and an integral, non-penetrated, complete, and penetrable diaphragm portion spanning and closing said filling passage.

2. The print cartridge of claim 1 further including a supply of printing fluid substantially filling said printing fluid chamber.

3. The print cartridge of claim 1 wherein said printing fluid chamber also includes a sponge member.

4. The print cartridge of claim 1 wherein said print cartridge body includes a closure member, said closure member being molded of polymer and defining a blind recess forming said filling passage.

5. The print cartridge of claim 4 wherein said penetrable diaphragm portion is molded integrally with said closure member.

6. A method of making a fluid jet print cartridge, said method comprising steps of:

providing a print cartridge body defining a printing fluid chamber;

providing a wall portion bounding said printing fluid chamber, and providing in said wall portion a filling passage extending between said printing fluid chamber and ambient but stopping short of communication of said printing fluid chamber outwardly of said print cartridge with ambient;

providing an integral fine-dimension diaphragm portion at said filling passage, said fine-dimension diaphragm portion being non-penetrated, complete, and spanning and closing said passage, and said diaphragm portion also bounding the printing fluid chamber;

penetrating a member through said fine-dimension diaphragm portion so that said diaphragm portion is thereafter penetrated, and injecting printing fluid into the printing fluid chamber via said penetrating member and penetrated diaphragm;

while injecting the printing fluid into the printing fluid chamber simultaneously utilizing the penetrated fine-dimension diaphragm portion to inhibit upwelling of said printing fluid about said penetrating member at said penetrated fine-dimension diaphragm portion and outwardly of said print cartridge along said filling passage.

7. The method of claim 6 also including the step of substantially filling said printing fluid chamber with printing fluid.

8. The method of claim 6 including the step of including in said printing fluid chamber a sponge member, and injecting the printing fluid into this sponge member via an opening formed in said fine-dimension diaphragm portion by penetration of said fine-dimension diaphragm portion.

9. The method of claim 6 further including the steps of: including in said print cartridge body a closure member, utilizing said closure member to both bound said printing fluid chamber and to define said filling passage, and forming said closure member to define a blind recess which forms said filling passage, closing said filling passage with an integral fine-dimension diaphragm portion of the closure member, utilizing said integral fine-dimension diaphragm portion of said closure member to define said fine-dimension diaphragm portion at said filling passage, and molding said closure member of polymer.

10. A method of making a fluid jet print cartridge, said method comprising steps of:

providing a print cartridge having a body portion and a lid portion, and utilizing said body portion and said lid portion to cooperatively define a printing fluid chamber;

providing one of said body portion and said lid portion with a wall portion bounding said printing fluid chamber, and providing in said wall portion a filling passage extending between said printing fluid chamber and ambient, providing for said filling passage to stop short of communication of said printing fluid chamber outwardly of said print cartridge with ambient;

providing an integral, non-penetrated, complete, fine-dimension diaphragm portion at said filling passage, and utilizing said fine-dimension diaphragm portion which is non-penetrated, complete, and spanning said filling passage to close said filling passage so that said filling passage stops short of communication between said printing fluid chamber and ambient, and said diaphragm portion also cooperatively bounding the printing fluid chamber;

penetrating a conduit member through said fine-dimension diaphragm portion to penetrate said diaphragm portion so that said fine-dimension diaphragm portion is no longer non-penetrated, but is thereafter still complete in spanning said filling passage except for penetration by said conduit member, and subsequently injecting printing fluid into the printing fluid chamber via said penetrating conduit member and penetrated diaphragm portion;

while injecting the printing fluid into the printing fluid chamber via said penetrating conduit member and penetrated diaphragm portion simultaneously utilizing the penetrated fine-dimension diaphragm portion which is still complete in spanning said filling passage to substantially sealingly engage said penetrating conduit member and to thereby inhibit upwelling of said printing fluid about said penetrating conduit member at said penetrated fine-dimension diaphragm portion, and thereby preventing flow of said printing fluid outwardly of said print cartridge along said filling passage.

11. The method of claim 10 further including the step of forming said fine-dimension diaphragm portion integrally with one of said print cartridge body portion and said lid portion.

12. The method of claim 10 also including the step of substantially filling said printing fluid chamber with printing fluid.

13. The method of claim 10 including the step of including in said printing fluid chamber a sponge member, penetrating said conduit member also into said sponge member after penetration of said conduit member through said fine-dimension diaphragm portion.

* * * * *